US005725283A

United States Patent [19]

O'Neill

[11] Patent Number: 5,725,283

[45] Date of Patent: Mar. 10, 1998

[54] APPARATUS FOR HOLDING A CUTTING BIT

[75] Inventor: Michael Lee O'Neill, Lucinda, Pa.

[73] Assignee: Joy MM Delaware, Inc., Wilmington, Del.

[21] Appl. No.: 633,228

[22] Filed: Apr. 16, 1996

[51] Int. Cl.[6] ..... E21C 35/183; E21C 35/197

[52] U.S. Cl. ..... 299/104; 299/106

[58] Field of Search ..... 299/104, 106, 299/107, 108

[56] References Cited

U.S. PATENT DOCUMENTS

| | | | |
|---|---|---|---|
| 2,800,302 | 7/1957 | McClennan | 175/391 |
| 3,143,177 | 8/1964 | Galorneau et al. | 175/413 |
| 3,537,539 | 11/1970 | Adcock | 175/413 |
| 3,717,209 | 2/1973 | Sheldon et al. | 175/413 |
| 3,771,612 | 11/1973 | Adcock | 175/413 |
| 3,841,708 | 10/1974 | Kniff et al. | 299/104 |
| 4,014,395 | 3/1977 | Pearson | 175/426 |
| 4,247,150 | 1/1981 | Wrulich et al. | 299/104 |
| 4,337,980 | 7/1982 | Krekeler | 299/102 |
| 4,478,299 | 10/1984 | Dorosz | 175/369 |
| 4,561,698 | 12/1985 | Beebe | 299/104 |
| 4,700,790 | 10/1987 | Shirley | 175/428 |
| 4,728,153 | 3/1988 | Ojanen et al. | 299/107 |
| 5,088,797 | 2/1992 | O'Neill | 299/104 |
| 5,273,343 | 12/1993 | Ojanen | 299/104 |
| 5,302,005 | 4/1994 | O'Neill | 299/87.1 |

FOREIGN PATENT DOCUMENTS 536728 5/1984 Australia .

*Primary Examiner*—David J. Bagnell
*Attorney, Agent, or Firm*—Kirkpatrick & Lockhart LLP

[57] ABSTRACT

Apparatus for supporting a mining bit in a bit holder which attaches to the rotatable drum of a mining machine. The apparatus comprises a sleeve that is adapted to be received in aperture in the bit holder. The sleeve has an aperture therethrough for rotatably receiving a cutting bit. The sleeve has a body portion and a collar which serves to prevent axial movement of the sleeve relative to the bit holder. An under cut area is provided in the body portion and/or the collar to reduce the peak amount of stress that develops between the body portion and collar. The bit holder and sleeve are constructed such that the position of the sleeve may be fixed axially with respect to the body portion by an interference fit in such a manner that it may be easily removed from the body portion.

25 Claims, 11 Drawing Sheets

APPARATUS FOR HOLDING A CUTTING BIT

BACKGROUND OF THE INVENTION

1. Field of the Invention

The present invention relates to holders for cutting bits of the type used to dislodge materials such as coal and the like from underground seams and, more particularly, to a miner bit holder which includes a bit holder attached to a rotating cutting drum and which receives a pressed-in replaceable sleeve for rotatably receiving a cutting bit.

2. Description of the Invention Background

In the materials mining industry, it is typical to employ a mining apparatus which includes a vertically moveable rotating cutting drum which has cutting bits attached thereto. By virtue of the rotation of the cutting drum and the movement of the miner into the material to be mined, the material is removed for further processing.

It is well known that such cutting bits and their holders are subjected to considerable stresses during the mining operation. Such stresses occur axially, vertically and transverse relative to the cutting bit. Accordingly, in normal mining operations, cutting bits require frequent replacement due to wear or breakage. In fact, cutting bits must often be replaced on a daily basis. In view of these conditions, much effort has heretofore been directed to the provision of readily replaceable cutting bits which may be removed with a minimum of effort from their supports.

Because the bit holding devices are not the primary vehicles by which material is removed from the mine face, the bit holding devices are generally characterized by a longer service life. As such, bit holding systems have been developed which include a bit holder which retains the cutting bit and which may be mounted into the miner's cutting drum. While such bit holders typically allow the cutting bit to rotate to avoid uneven wear on the bit, they may, alternatively, fix the cutting bit in one position. Nevertheless, the bit holders themselves are subject to considerable wear at the mine face and their breakage may require replacement on two to six month intervals. Further, when the bit holders are designed to allow bit rotation, such relative movement quickly wears the holding surfaces of the bit holder thereby rendering them unusable. It is well known that replacement of bit holders results in considerable expense and down time for the capital intensive mining machinery.

In an effort to address these problems, bit holding devices have been developed which include a replaceable sleeve disposed between the bit holder and the cutting bit. The use of these sleeves extends the life of the bit holders by limiting the internal wear to which the bit holder is subjected. In the past, sleeves have been either freely rotatable within the bit holder, or they have been permanently fixed in one position relative to the bit holder. The sleeve of the rotatable type has a longer service life than a nonrotatable sleeve due to even wearing on sleeve surfaces which contact the mine face. However, rotatable sleeves wear and ultimately destroy the internal surfaces of the bit holders in which they rotate.

In the past, certain non-rotatable sleeves have been held in place by means of an interference fit along the entire length of the sleeve. With this type of interference fit it is difficult, if not impossible, to remove the sleeve in the field. For example, forces in excess of 72,000 lbs. are necessary to remove some sleeves. Forces of such magnitude may not reasonably be generated in the extreme environments in which such cutting bits are used. I find that it would not be practical to provide an interference fit along the entire length of the sleeve which would allow its reasonable removal because the manufacturing tolerances which would be so required would be quite cost-prohibitive.

In certain applications, others have attempted to provide an interference fit directly between the bit holder and a cutting bit. Although Applicant believes these solutions are unsatisfactory because no sleeve is provided to prevent excessive wear on the bit holder, such configurations are shown in U.S. Pat. No. 2,800,302 to McLennan and U.S. Pat. No. 3,143,177 to Galorneau et al. Applicant is of the view that an additional fundamental flaw in those designs prohibits their use in mining bits which are subjected to massive axial loads. In those designs, the interference fits are formed by two (2) conical surfaces on the bit which engage a bore in the bit holder. However, because there is no shoulder provided to resist axial forces encountered during cutting, it is believed that the axial forces encountered in mining applications will cause the conical surfaces to split the bit holder.

The above-mentioned problems have been solved by the bit holder arrangements disclosed in my U.S. Pat. Nos. 5,088,797 and 5,302,005 the disclosures of which are herein incorporated by reference. Those patents disclose a sleeve and bit holder that are constructed such that the position of the sleeve may be fixed axially with respect to the body portion of the bit holder by means of an interference fit in such a manner that it may be manually removed from the bit holder. Such "press-fitted" sleeves have an external, forward-facing collar adjacent to a cylindrical body portion. A fillet radius is typically formed where the collar adjoins the body portion. The cylindrical body portion is pressed into an aperture in the bit holder and retained therein by an interference fit generated therebetween. As the cylindrical body portion is pressed into the bit holder aperture, the rigid collar tends to resist such inward displacement which results in the build up of high shear stresses at the root of the fillet radius between the cylindrical body portion and the collar. Such build up of stress at the root of the fillet radius may result in the premature failure of the sleeve.

Thus there is a need for a pressed-in sleeve arrangement that has an improved service life over the service lives of prior pressed-in bit holding sleeves.

SUMMARY OF THE INVENTION

The present invention is directed to an apparatus for supporting a mining bit in a bit holder that attaches to the rotatable drum or cutting element of a mining machine. The bit holder includes a base portion and a body portion. The body portion has an aperture which is adapted to receive a sleeve. The sleeve is of unitary construction and includes a body member and preferably includes a collar forming a shoulder at one end to transmit axial forces to the body member while providing protection for the body member. A first tapered portion is preferably provided in the body member adjacent the collar. A second tapered portion is provided in the collar adjacent the body member and adjoins first tapered portion to create an undercut area which serves to reduce the peak amount of stress that develops where the collar and body member meet. The sleeve has a bore therethrough for rotatably receiving a cutting bit having an extended shaft.

The sleeve and bit holder are constructed such that the rotation of the sleeve may be prevented with respect to the body portion by means of an interference fit therebetween.

Additionally, the sleeve and bit holder are constructed such that the sleeve may be removed in the mine from the body portion with a minimum of effort when replacement is indicated.

Accordingly, the present invention provides solutions to the aforementioned problems with miner bit holding apparatuses. The present invention provides a sleeve adapted to be received in a cutting bit holder and fixed in place with respect to the bit holder by means of an interference fit which allows the sleeve to be manually removed from the bit holder. Also, due to the provision of an undercut area in the collar and/or the body portion of the sleeve, the various preferred embodiments of the subject invention also have longer service lives than the service lives that are characteristic of prior sleeves.

These and other details, objects and advantages of the present invention will become apparent as the following description of the preferred embodiment thereof proceeds.

DESCRIPTION OF THE DRAWINGS

In the accompanying drawings, there are shown present preferred embodiments of the invention wherein.

DETAILED DESCRIPTION OF THE PREFERRED EMBODIMENTS

Figure 1:
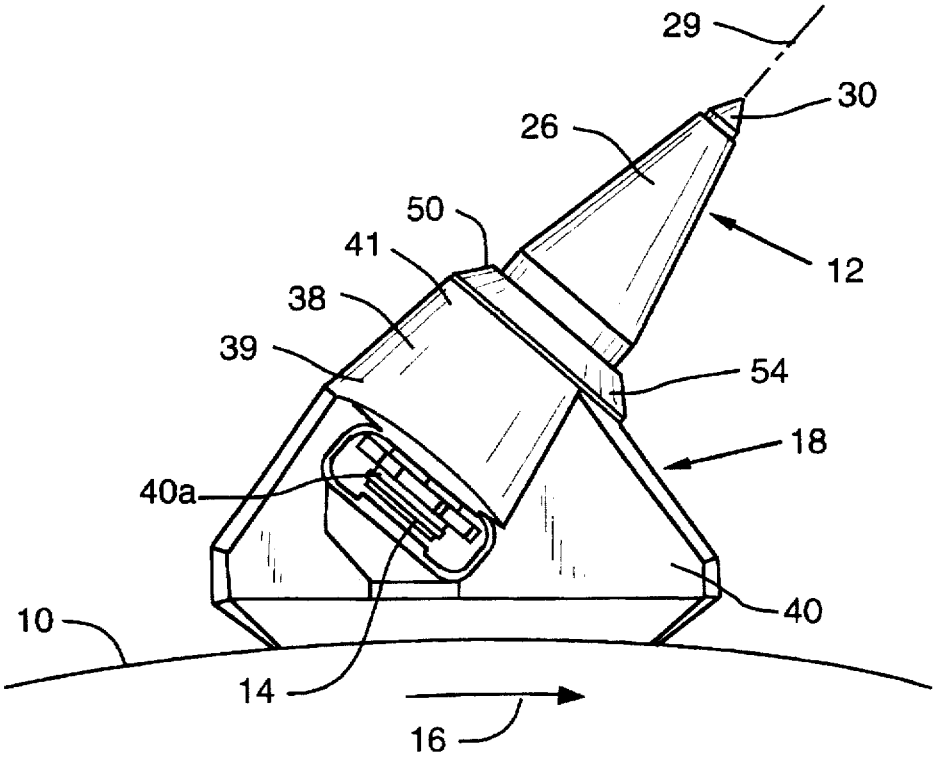
FIG. 1 is a side elevation view of the cutting bit holding apparatus according to the present invention.
Figure 2:
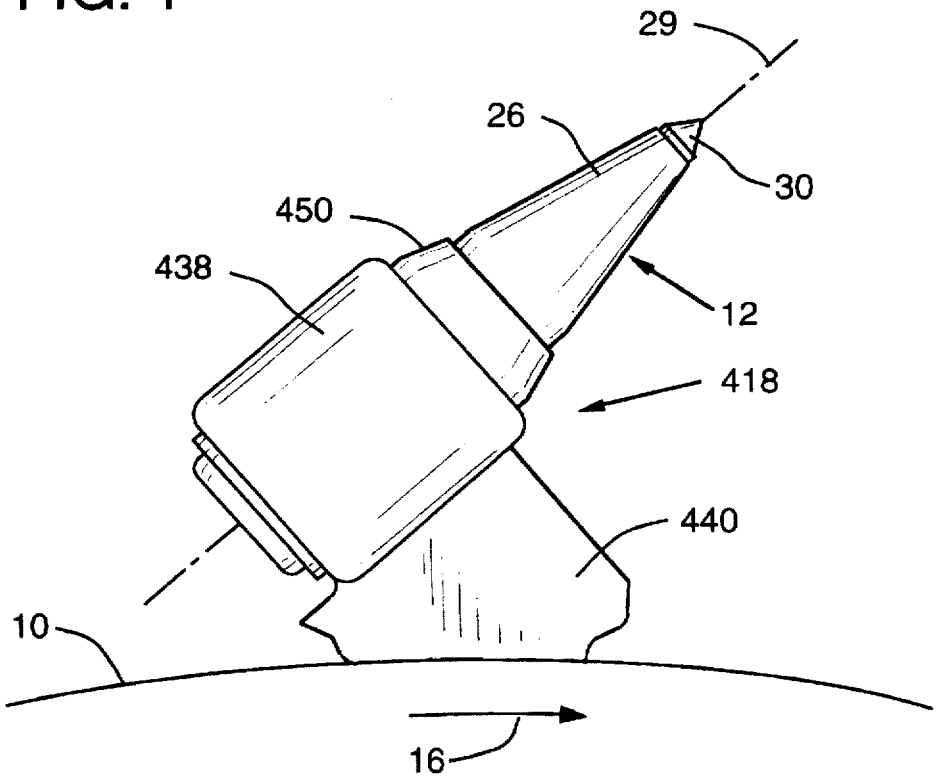
FIG. 2 is a side elevation view of another embodiment of the cutting bit holding apparatus according to the present invention.
Figure 3:
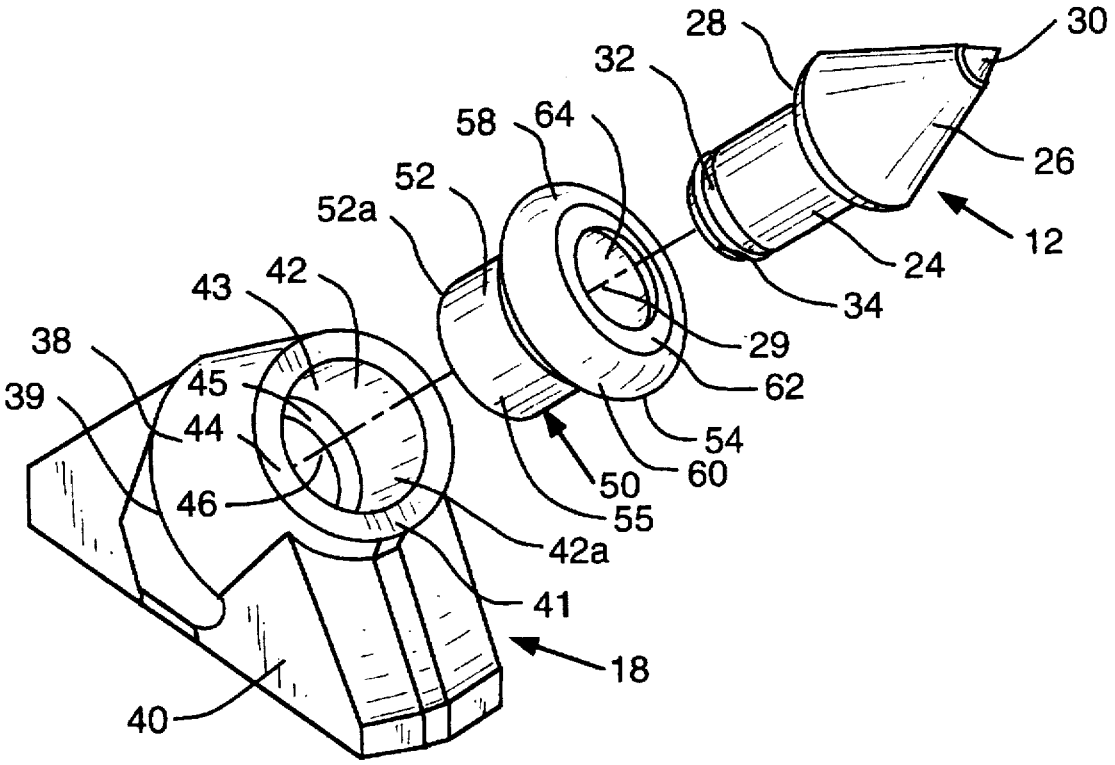
FIG. 3 is an exploded perspective view of one embodiment of the bit holding apparatus according to the present invention.
Figure 4:
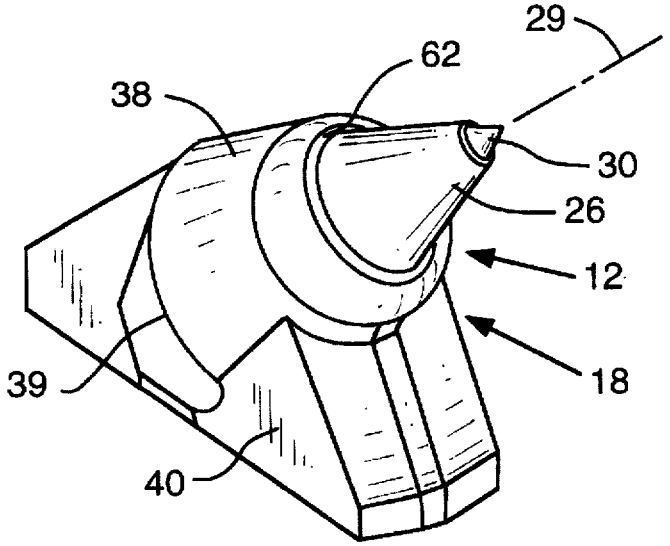
FIG. 4 is a perspective assembly view of the bit holding apparatus of FIG. 3.
Figure 5:
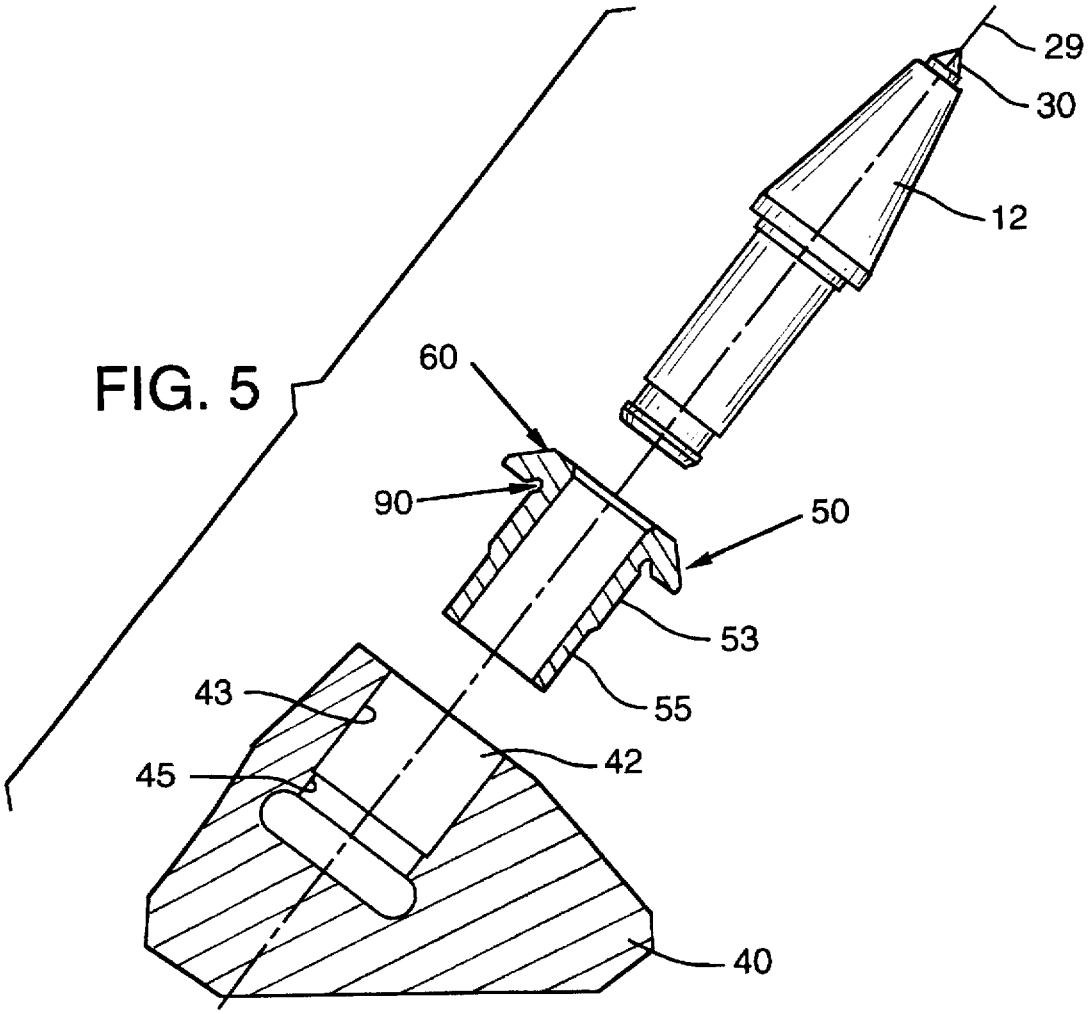
FIG. 5 is an exploded cross sectional view of one of the bit holding apparatus of FIG. 3 with the bit being shown as a solid for purposes of clarity.
Figure 6:
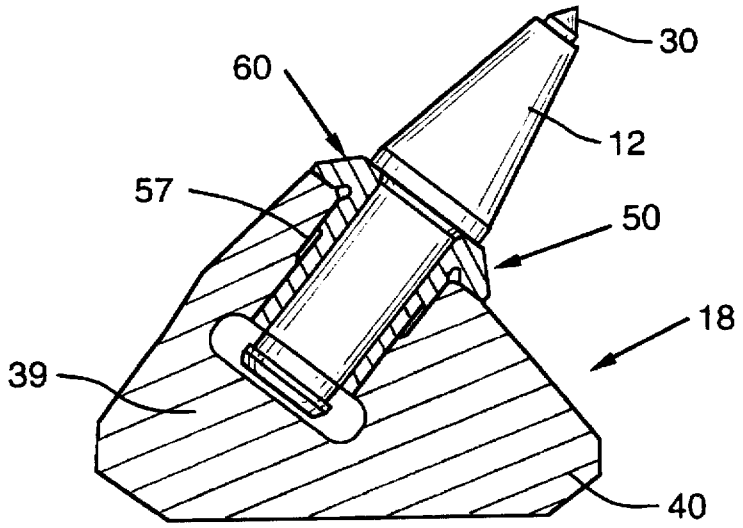
FIG. 6 is a cross sectional assembly view of the bit holding apparatus of FIG. 3 with the bit being shown as a solid for purposes of clarity.

Referring now to the drawings wherein the showings are for purposes of illustrating the present preferred embodiments of the invention only and not for purposes of limiting the same, the Figures show a mining machine cutting drum 10 which supports a cutting bit 12 by means of a bit holder 18.

More particularly and with reference to FIG. 1, there is depicted the cutting drum 10 of a mining machine which is supported thereby for rotation in the direction shown by the arrow 16. As is well known in the art, the cutting drum 10 is supported by the mining machine for rotation while being vertically moveable and while the mining machine advances forward which may be viewed as left to right as shown in FIG. 1. As is also well known, the cutting drum 10 typically includes a plurality of cutting bits 12 arranged thereon; however, the present description will now be directed to a single cutting bit 12 and the structure of a single present bit holder 18.

Generally speaking, the bit holder 18 may be attached directly or indirectly to the drum 10. For example, the bit holder may be welded or clamped to the drum 10 or may be secured to a mounting block attached to the drum 10. As described hereinafter, the bit holder 18 receives and retains a sleeve 50 which rotatably receives the bit 12.

The cutting bit 12 may be of a previously established design including a central cylindrical shank portion 24 and having an enlarged conical nose 26 attached thereto such that a shoulder area 28 is formed therebetween. The cutting bit has a central axis shown at 29 with a hard cutting tip 30 on one end of the cutting bit 12 of a material and in a manner known in the art. The cutting bit 12 includes on its other end a recessed notch 32 and terminates in an end shoulder 34 such that a retaining ring (not shown) may be received within the notch 32 to prevent the axial removal of the cutting bit 12 from the sleeve 50.

In one embodiment of the invention, as seen in FIGS. 3, 4, 5 and 6, the bit holder 18 has a body portion 38 and a base portion 40. The base portion 40 attaches directly to the cutting drum 10 or indirectly by means of a mounting block (not shown). The body portion 38, which is integral to the base portion 40, includes an aperture 42 for receiving a coaxial sleeve 50. The aperture 42 defines an inner surface **42*a* which includes two segments of differing diameters, namely, a first segment 43 and a second segment 45 of slightly smaller diameter. The difference in diameter could be, for example on a diameter of segment 43 of one and seven-eights, on the order of one-thirty second of an inch. The body portion 38 has two ends, a trailing end 39 which faces away from the direction of rotation and the leading end 41 which faces toward the direction of rotation. The body portion 38 includes a contact face 44 which is shown as perpendicular to the longitudinal axis 46, which is the same as the central axis 29, of the aperture 42**.

As was noted above, sleeves that are pressed into bit holders and retained in position by an interference fit generated therebetween have prematurely failed at times, due to the large amount of stresses that build up in the root of the fillet joint where the collar adjoins the body of the sleeve. I have discovered, however, that by providing a different connection between the sleeve body and the collar, the shear stresses are distributed over a larger area which, ultimately, results in a lower peak shear stress being developed at the joint.

Figure 7:
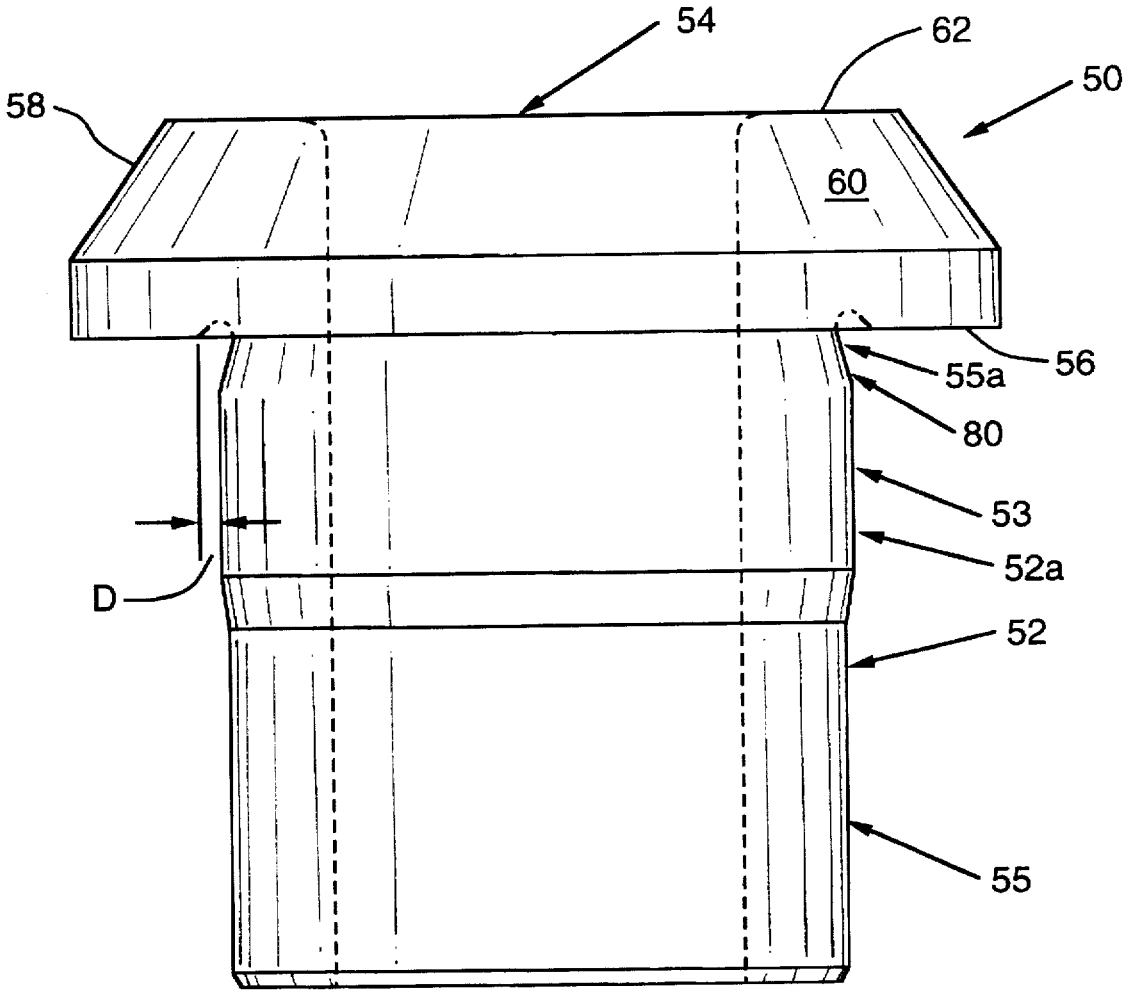
FIG. 7 is a side elevational view of the preferred sleeve FIGS. 5 and 6.
Figure 8:
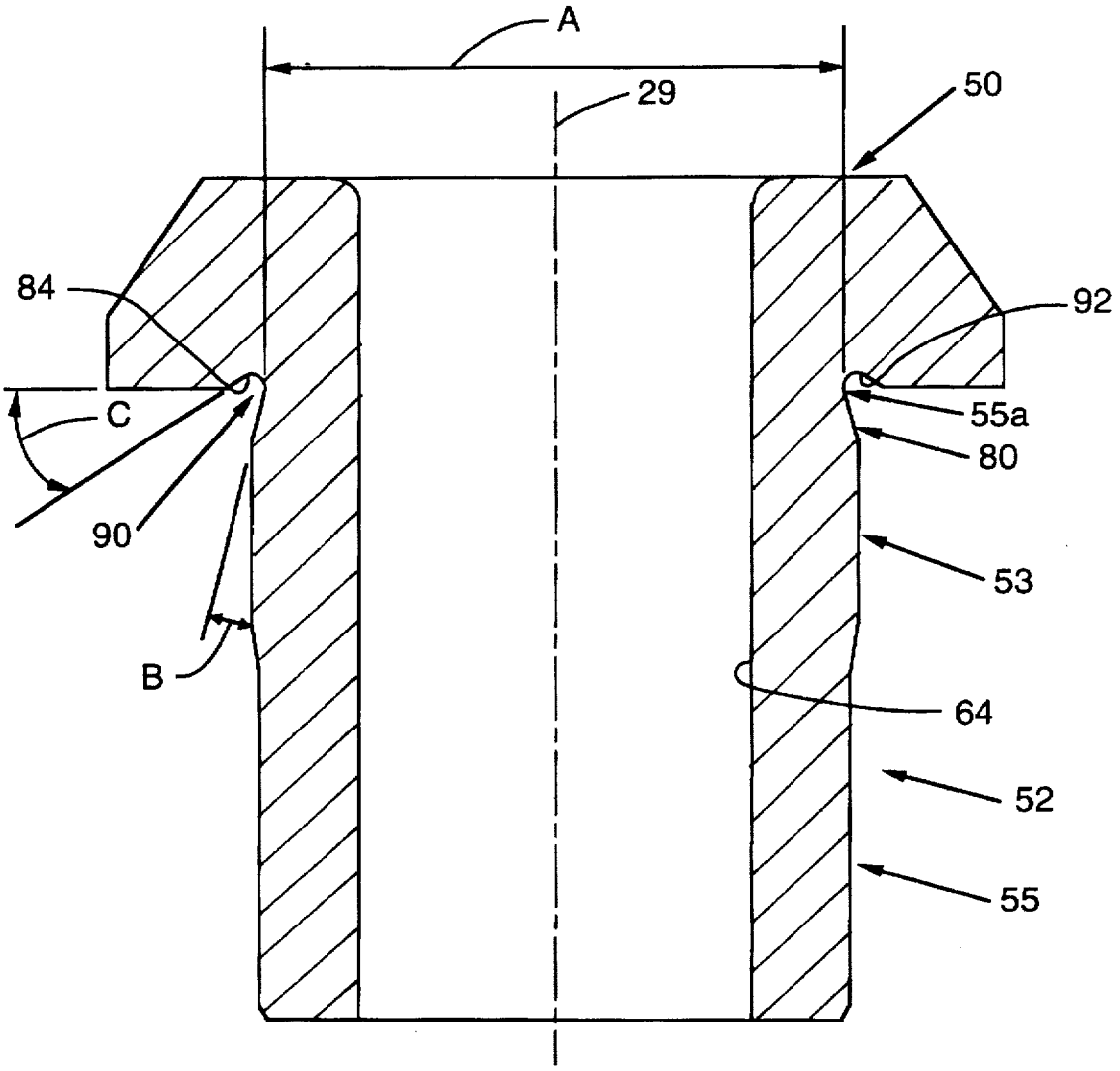
FIG. 8 is a cross-sectional view of the sleeve of FIG. 7.

FIGS. 7 and 8 depict a preferred sleeve arrangement that employs a less rigid connection between the collar of the sleeve and the sleeve body. As can be seen in those Figures, sleeve 50 has an elongated body member 52 and a collar 54. The collar 54 is provided with an inside surface 56 and an outside surface 58. The inside Surface 56 of the collar 54 is adapted to abut the contact face of a bit holder of the type described hereinabove. The outside surface 58 of the collar 54 preferably has a beveled surface 60 and a flat surface 62. The body member 52 of the sleeve 50 defines an outer surface **52*a* which also includes two segments of differing diameters, a first segment 53 and a second segment 55**.

The first segment 53 of the sleeve 50 is sized such that an interference fit is created between the first segment 53 of the sleeve 50 and the first segment 43 of the aperture 42 in the bit holder. Similarly, the second segment 55 of the sleeve 50 is of a decreased diameter, such as by one-thirty second of an inch, so that an interference fit is created between the second segment 55 of the sleeve 50 and the second segment 45 of the aperture 42. The segments 43, 45, 53, 55, respectively are of sufficient length such that an area of non-interference 57 is created. See FIG. 6. The amount of interference between the segments 43 and 53, respectively, and 45 and 55, respectively, is preferably between 0.002–0.005 inches. Such areas of interference are referred to as bands of interference and are shorter than the length of the sleeve.

As will now be appreciated by those skilled in the art, in the machining of the aperture 42, and by analogy, the body member 52, the diameter of the second segment 45 may be rough machined and then the diameter of the first segment 43 may be rough machined. Thereafter, the actual diameter of second segment 45 may be machined followed by the actual diameter of the first segment 43, but only in the area where segment 53 will engage it. As such actually three (3) diameters will be formed, the actual diameters of segments 43 and 45 and the rough diameter of segment 43, which is less than the preferred diameter 43 as by ten thousandths of an inch.

The body member 52 of the sleeve 50 has a bore 64 which is coaxial with the bit axis 29 when a bit is received therein. The bit 12 is rotatably received by the bore 64. The shank 24 of the bit 12 is slightly smaller than the bore 64. The shank 24 is retained in the bore 64 by the retaining ring and the shank may rotate about the central axis 29 in order to avoid uneven wearing of the tip 30 of the cutting bit 12. The shoulder area 28 of the bit 12 abuts the flat surface 62 to position the bit 12 axially in the bore 64 and transmit cutting forces.

To reduce the amount of peak stress in the area where the collar 54 adjoins the body member 52, the outer surface **52*a* of the body member 52 includes a "first" tapered surface 55*a* which tapers inwardly from segment 53 to collar 54 to form a tapered portion 80. The diameter of the tapered portion 80 where it adjoins the collar 54 is preferably approximately 1.800" (represented by arrow "A" in FIG. 8) which is less than the diameter of segment 53. As can be seen in FIG. 8, the tapered portion 80 is preferably tapered at angle of approximately 10° (represented by arrow "B" in FIG. 8). Also in this embodiment, the portion of the inside surface 56 of the collar 54 that is adjacent the body member 52 includes a "second" tapered surface 84 that tapers inwardly at approximately a 10° angle (represented by arrow "C" in FIG. 8). A radius 92 is preferably formed where the first surface 55*a* meets the second surface 84. The outer edge of the second tapered surface 84 is preferably approximately 0.16" from the outer surface of segment 53 (represented by arrow "D" in FIG. 7). The skilled artisan will appreciate that the tapered portion 80 of the body member 52 and the tapered surface 84 of the collar 54 cooperate to form an undercut area, generally designated as 90, where the body member 52 adjoins the collar 54. The undercut area 90 is the area in the collar 54 and the body 52 that has less material than the adjacent portions of the body 52 and the collar 54. It will be further appreciated that such undercut area 90 serves to distribute the stresses that develop in the area where the collar 54 adjoins the body member 52** which, ultimately, reduces the peak stress developed in that area.

Figure 9:
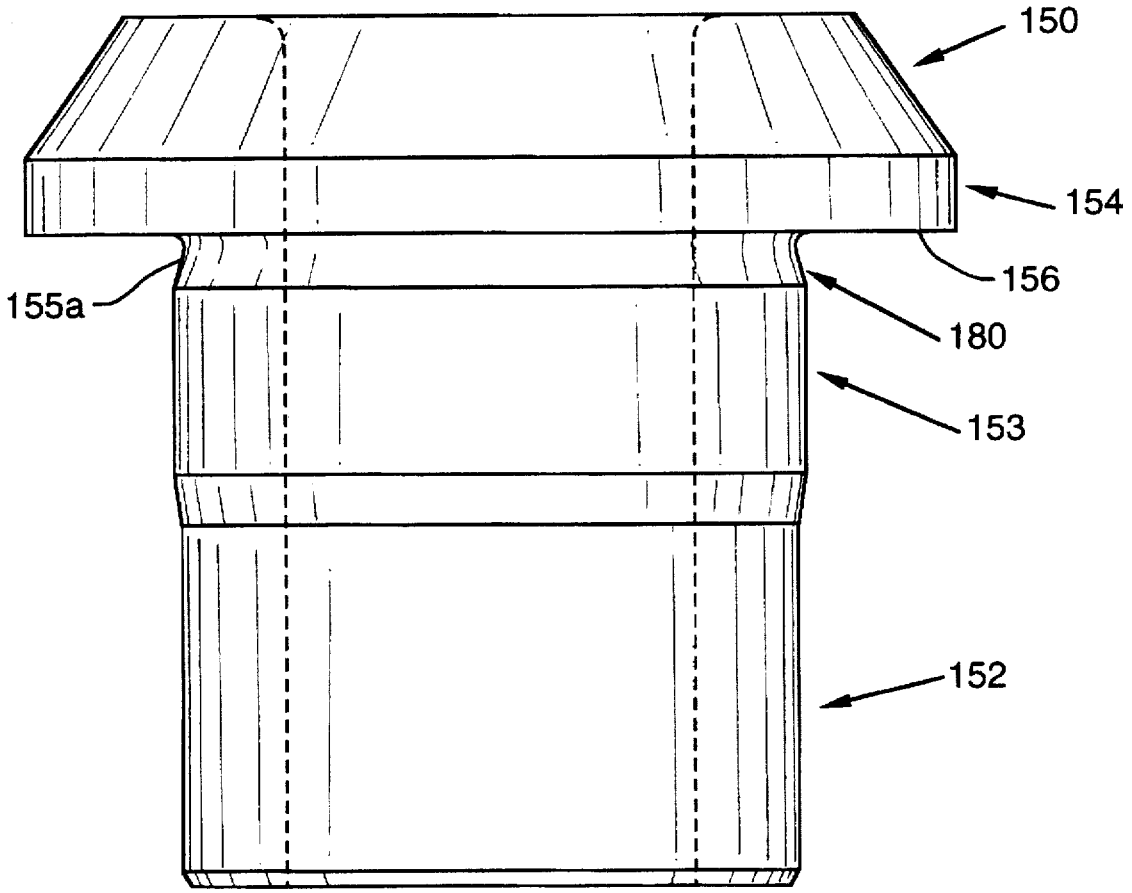
FIG. 9 is a side elevational view of another preferred sleeve of the present invention.
Figure 10:
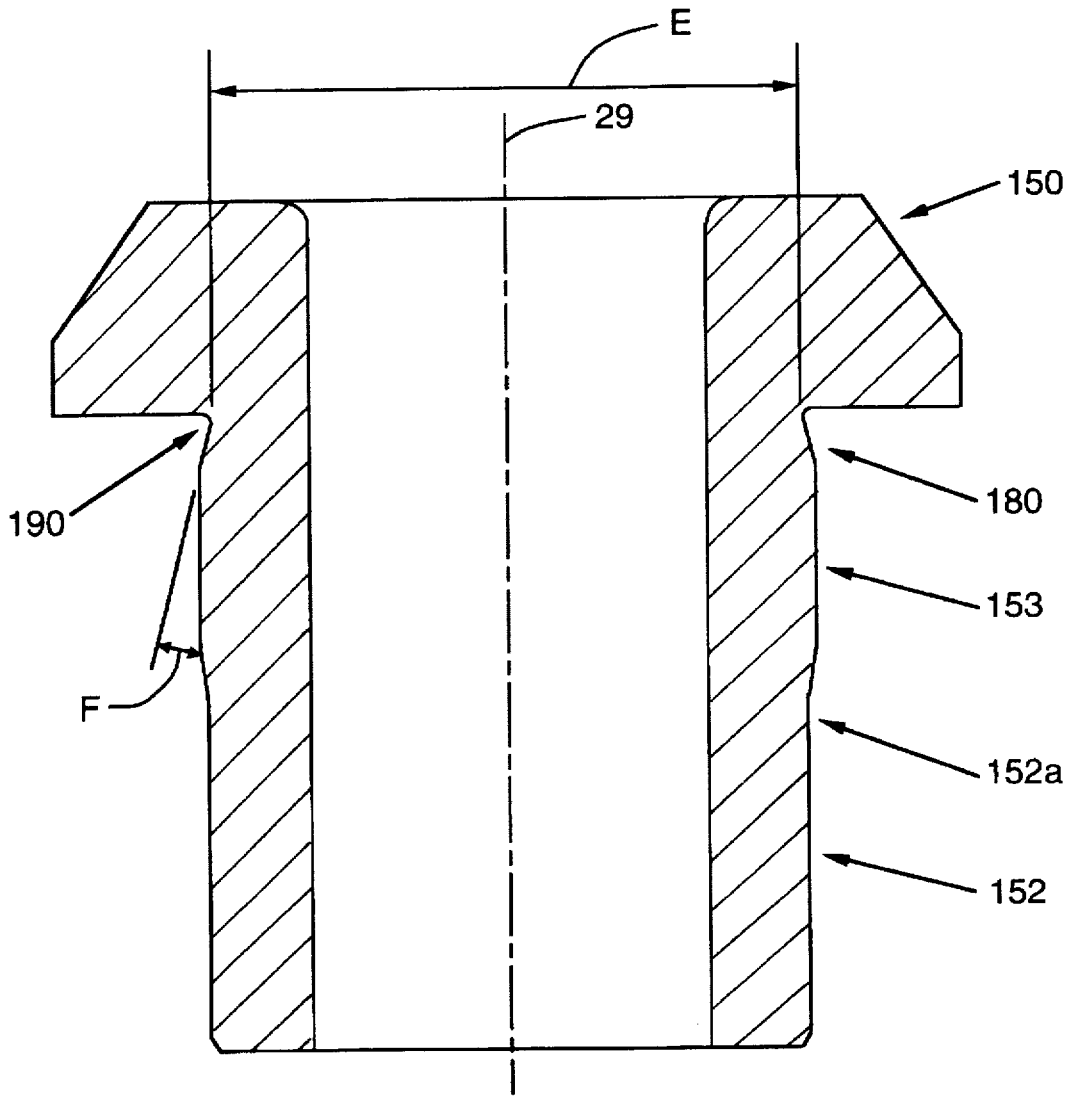
FIG. 10 is a cross-sectional view of the sleeve of FIG. 9.

In another embodiment, as seen in FIGS. 9 and 10 where the similar elements have the same reference numbers as described above and where analogous elements have referenced numerals which are increased by 100, sleeve 150 has an elongated body member 152 and a collar 154. In this embodiment, inside surface 156 of the collar 154 is substantially perpendicular to the axis 29 extending through the sleeve 150. The outer surface **152*a* of the body member 152 has a tapered surface 155*a* that tapers inwardly from segment 153 to collar 154 to form a tapered portion 180. The diameter of the tapered portion 180 where it adjoins the collar 154 is preferably approximately 1.815" arrow "E" in FIG. 10) which is less than the diameter of segment 153. As can be seen in FIG. 10, the tapered portion 180 is preferably tapered at angle of 10° (represented by arrow "F" in FIG. 10). Those of ordinary skill in the art will appreciate that the tapered portion 180 forms an undercut area 190 in the sleeve body 152 which serves to distribute the stresses occurring at the point where the collar 154 adjoins the sleeve body 152** to thereby reduce the peak stresses developed therein.

Figure 11:
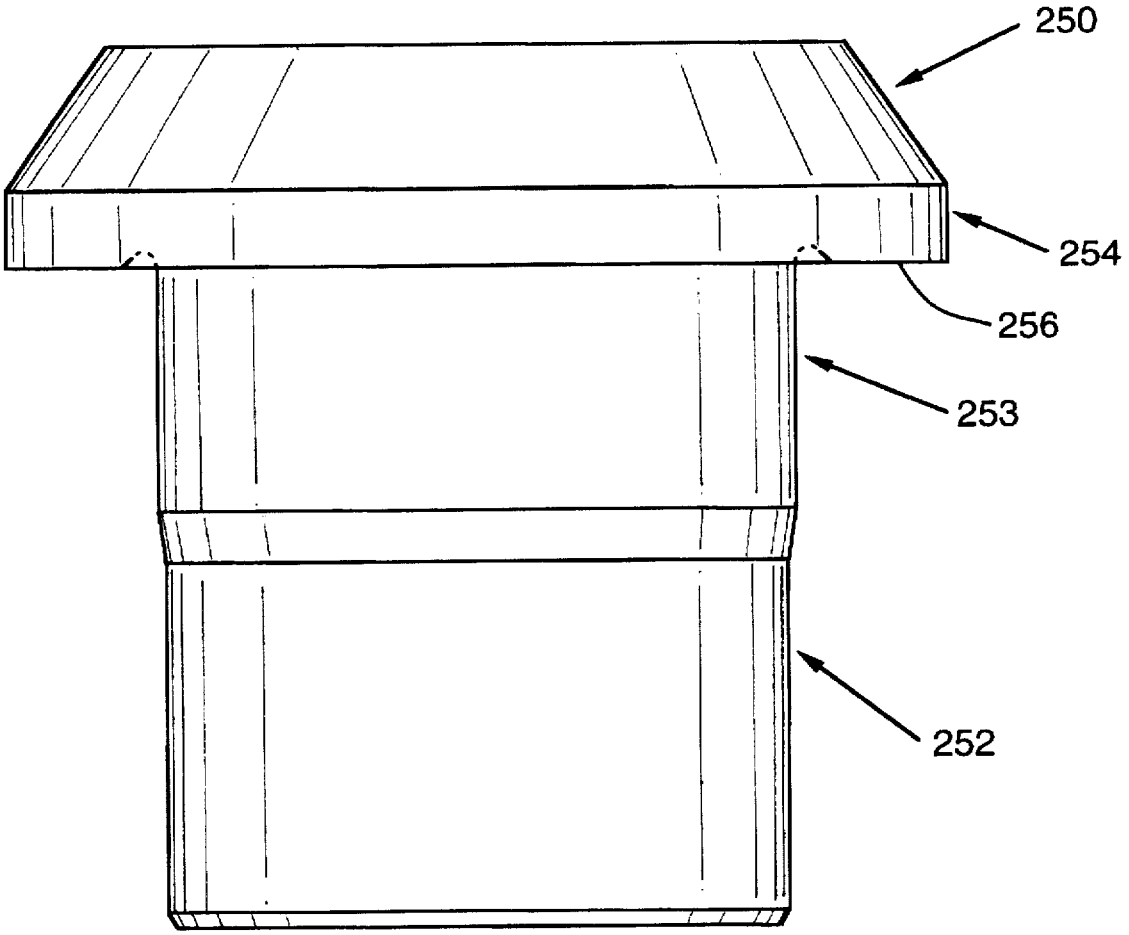
FIG. 11 is a side elevational view of another preferred sleeve of the present invention.
Figure 12:
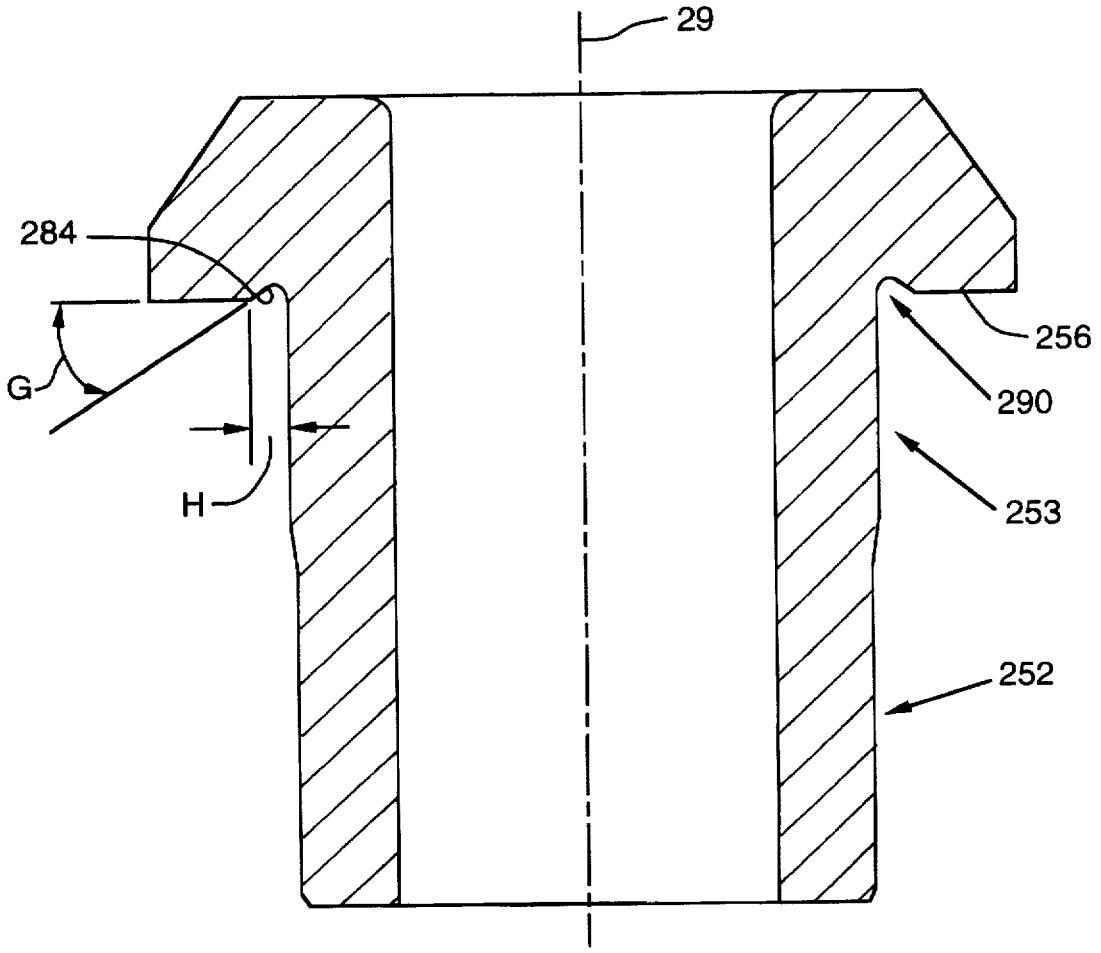
FIG. 12 is a cross-sectional view of the sleeve of FIG. 11.

Yet another preferred sleeve embodiment is depicted in FIGS. 11 and 12. As can be seen in those Figures, sleeve 250 has an elongated body member 252 and a collar 254 and, except for the differences noted below, has the same attributes as sleeve 50. In this embodiment, however, the edge of segment 253 is substantially parallel with the axis 29. The portion of the inside surface 256 of the collar 254 that is adjacent the body member 252 has a tapered surface 284 that tapers inwardly at a 10° angle (represented by arrow "G" in FIG. 12). The outer edge of the tapered surface 284 is preferably approximately 0.16" from the outer surface of segment 253 (represented by arrow "H" in FIG. 12). It will be appreciated that the tapered surface 284 forms an undercut area 290 in the collar 254 where the collar 254 adjoins the body member 252 to distribute the stresses formed therein which, ultimately, reduces the peak stress formed in that area.

Figure 13:
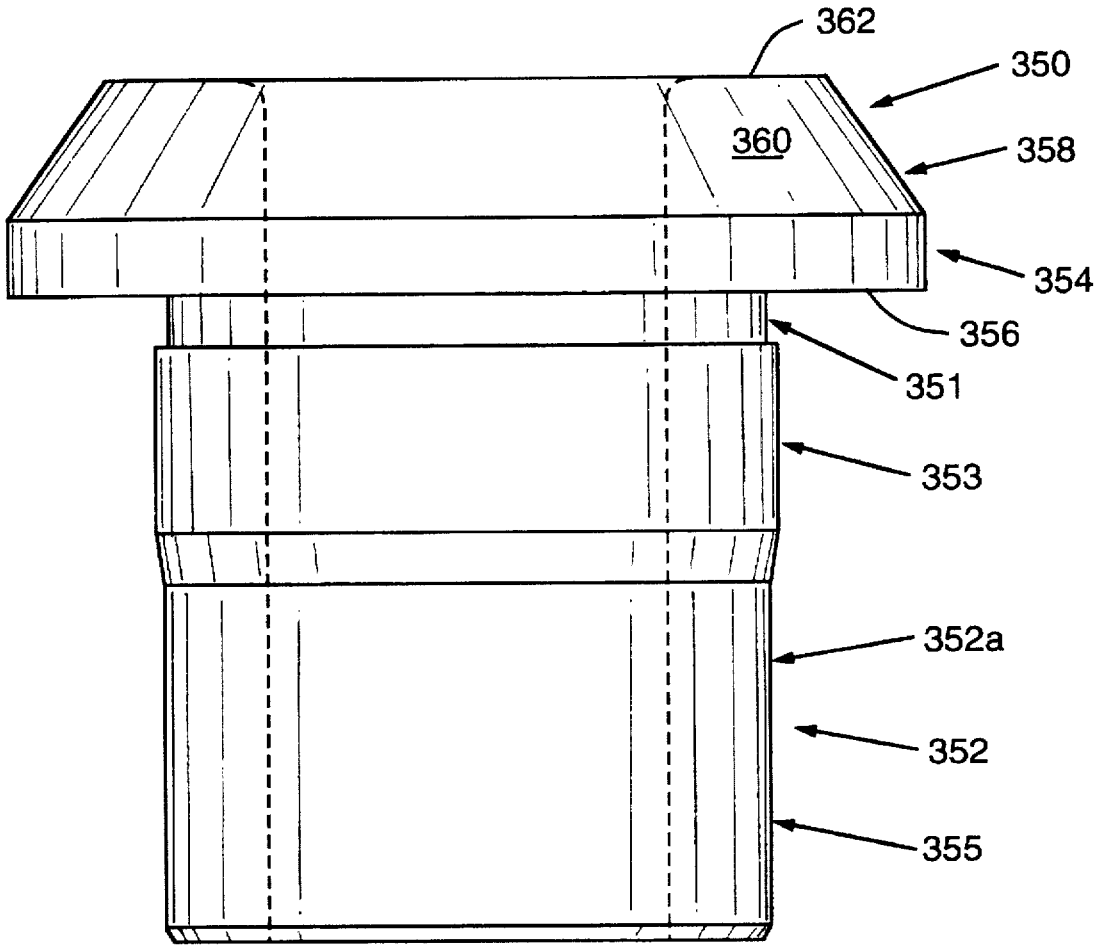
FIG. 13 is a side elevational view of another preferred sleeve of the present invention.
Figure 14:
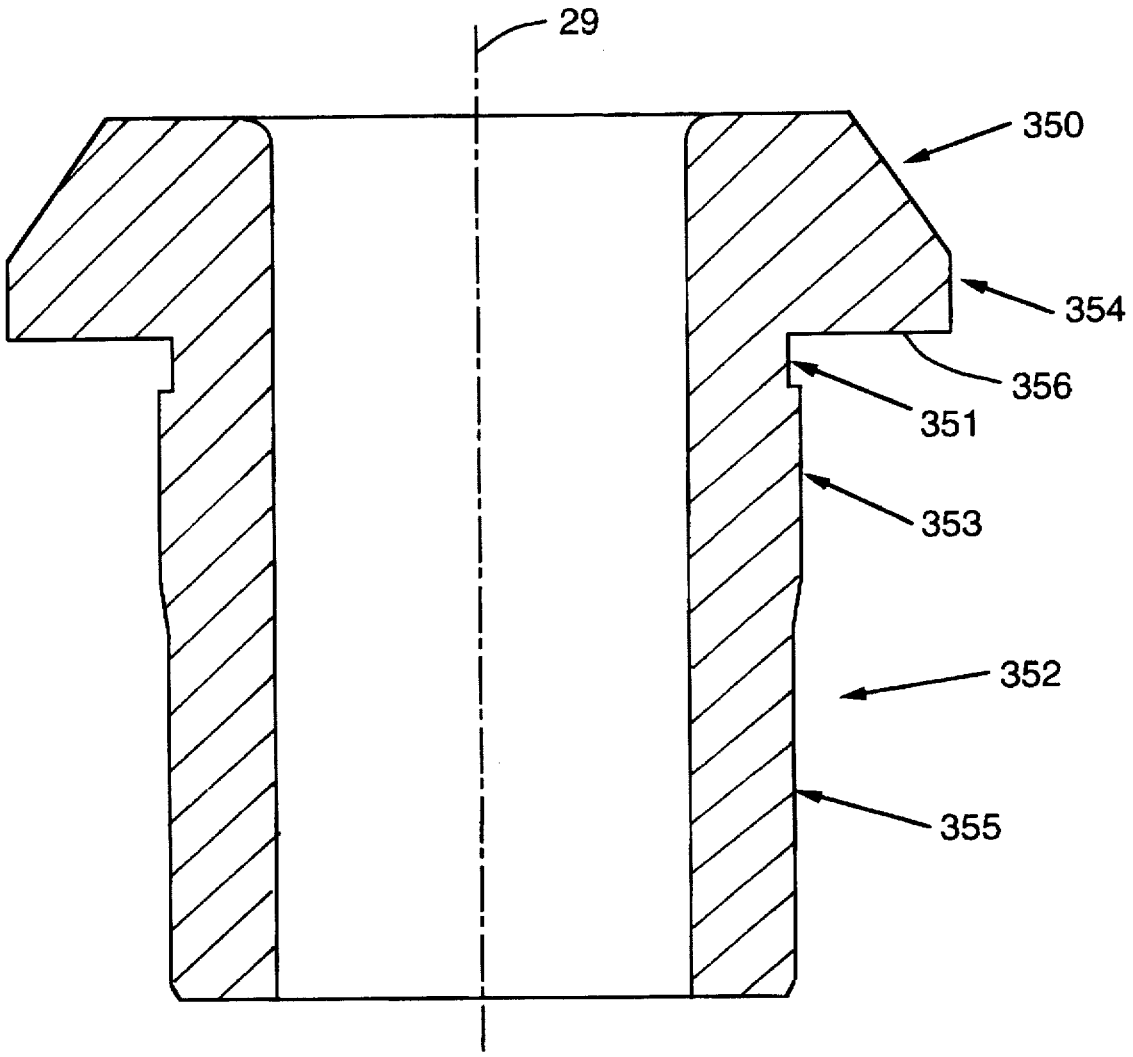
FIG. 14 is a cross-sectional view of the sleeve of FIG. 13.

Another sleeve embodiment is depicted in FIGS. 13 and 14. The sleeve 350 depicted in FIGS. 13 and 14 has an elongated body member 352 and a collar 354, the collar 354 having an inside surface 356 and an outside surface 358. The inside surface 356 of the collar 354 is adapted to abut the contact face of a bit holder of the type described hereinabove. The outside surface 358 of the collar 354 preferably has a beveled surface 360 and a flat surface 362. The body member 352 of the sleeve 350 defines an outer surface **352*a* which also includes three segments of differing diameters, a first segment 351, a second segment 353 and a third segment 355. The second segment 353 of the sleeve 350 is sized such that an interference fit is created between the second segment 353 of the sleeve 350 and the first segment 43 of the aperture 42 in the bit holder. Similarly, the first and third segments (351, 355) of the sleeve 350 are of decreased diameters. For example, the first segment has a diameter that is preferably 1/32" segment and the third segment diameter is preferably one-thirty second of an inch less than the diameter of the second segment, so that an interference fit is created between the second segment 353 of the sleeve 350 and the first segment 43 of the aperture 42 and a second interference fit is created between the third segment 355 and the second segment 45 of the aperture 42. The segments 43, 45, 353, 355, respectively are of sufficient length such that areas of non-interference are created between the sleeve 350 and the bit holder. The amount of interference between the segments 43 and 353, respectively, and 45 and 355**, respectively, is preferably between 0.002–0.005 inches. Such areas of interference are referred to as bands of interference and are shorter than the length of the sleeve.

It will be appreciated by those skilled in the art that the foregoing embodiments could be manufactured in conjunction with other styles of bit holders but are preferably manufactured as described in U.S. Pat. Nos. 5,088,797 and 5,302,005 such that an interference fit is established between the sleeve and the bit holder. Such interference fits preferably permit the sleeves to be removed manually from their respective bit holders by the application of a punch or hydraulic device while the bit holder remains attached to the cutting drum of the mining machine. The punch or hydraulic device would drive the sleeve against the bands of interference to remove the sleeve from the bit holder.

As described above, I prefer that the amount of insertion or removal forces to be approximately 15,000 to 40,000 lbs. It will be appreciated by those skilled in the art that the cutting bit holding apparatuses may also find utility on cutting apparatuses which do not have a rotating drum, for example, those which only impart a linear motion to the cutting bit. Moreover, cutting apparatuses which may advantageously employ this invention are found in other fields of endeavor such as in pavement removal apparatuses or any other apparatus for cutting hard surfaces such as those encountered relating to minerals.

The reader will further appreciate that the sleeves described above solve many of the problems encountered when affixing cutting bits to the rotatable drum of a mining machine or other digging and trenching apparatuses. It will also be appreciated that the provision of an undercut area in the collar and/or body of a pressed-in type sleeve at the joint where the collar adjoins the body serves to extend the life of the sleeve and thereby reduces the amount of machine downtime encountered when replacing failed sleeves. It will be understood, however, that various changes in the details, materials and arrangements of parts which have been herein described and illustrated in order to explain the nature of the invention, may be made by those skilled in the art within the principle and scope of the invention expressed in the appended claims.

What is claimed is:

1. Apparatus for supporting a cutting bit having an elongated shank and a shoulder, on a cutting element which is moveable in a cutting direction, in a bit holder having a base portion and a body portion, said base portion constructed for attachment to said cutting element, said body portion having a trailing end facing away from the cutting direction and a leading end facing in the cutting direction, said body portion further having a contact face and an aperture coaxial with the cutting bit and extending from said leading end toward said trailing end and defining an inner surface, comprising:

a sleeve member having an annular body member and a collar located at one end of said body member, said body member constructed to be received by said aperture in said body portion through said leading end of said body portion, said body member defining an outer surface having a first tapered portion adjacent said collar, said collar having an inside surface for engagement with said contact face to prevent axial movement of said sleeve member in a direction toward said trailing end, said inside surface having a second tapered portion adjacent said body member and adjoining said first tapered portion to form an undercut area, said sleeve member further having a bore therein for rotatably receiving the shank of the cutting bit such that the shoulder engages said outside surface of said collar; and retaining means on said outer surface of said sleeve for providing an area of interference fit between said inner surface and said outer surface adapted to prevent rotation and axial movement of the sleeve relative to said body portion while in use.

2. The apparatus of claim 1 wherein a radiused surface is formed where said first tapered surface adjoins said second tapered surface.

3. The apparatus of claim 1 wherein said means for retaining said sleeve member includes at least one band of interference fit between said inner surface and said outer surface which is shorter than said outer surface.

4. The apparatus of claim 1 wherein said means for retaining said sleeve member includes at least one band of interference fit between said inner surface and said outer surface and wherein said sleeve is cylindrical.

5. The apparatus of claim 1 wherein said means for retaining said sleeve member includes at least two discrete bands of interference fit between said inner surface and said outer surface.

6. The apparatus of claim 1 wherein said means for retaining said sleeve member includes at least two discrete bands of interference fit between said inner surface and said outer surface and wherein said sleeve is cylindrical.

7. The apparatus of claim 1 wherein said sleeve includes an area of increased diameter along said outer surface adjacent said leading end of said aperture and said aperture includes an area of reduced diameter adjacent said end of said aperture such that two bands of interference fit exist between said outer surface and said inner surface, one at said area of increased diameter of said outer surface and one at said area of reduced diameter of said inner surface.

8. Apparatus for supporting a cutting bit having an elongated shank and a shoulder, on a cutting element which is moveable in a cutting direction, in a bit holder having a base portion and a body portion, said base portion constructed for attachment to said cutting element, said body portion having a trailing end facing away from the cutting direction and a leading end facing in the cutting direction, said body portion further having a contact face and an aperture coaxial with the cutting bit and extending from said leading end toward said trailing end and defining an inner surface, comprising:

a sleeve member having an annular body member and a collar located at one end of said body member, said body member constructed to be received by said aperture in said body portion through said leading end of said body portion, said body member defining an outer surface having a first tapered portion forming an undercut area in said body member adjacent said collar, said collar having an inside surface for engagement with said contact face to prevent axial movement of said sleeve member in a direction toward said trailing end, said sleeve member further having a bore therein for rotatably receiving the shank of the cutting bit such that the shoulder engages said outside surface of said collar; and retaining means on said outer surface of said sleeve for providing an area of interference fit between said inner surface and said outer surface adapted to prevent rotation and axial movement of the sleeve relative to said body portion while in use.

9. The apparatus of claim 8 wherein said means for retaining said sleeve member includes at least one band of interference fit between said inner surface and said outer surface which is shorter than said outer surface.

10. The apparatus of claim 8 wherein said means for retaining said sleeve member includes at least one band of interference fit between said inner surface and said outer surface and wherein said sleeve is cylindrical.

11. The apparatus of claim 8 wherein said means for retaining said sleeve member includes at least two discrete bands of interference fit between said inner surface and said outer surface.

12. The apparatus of claim 8 wherein said means for retaining said sleeve member includes at least two discrete bands of interference fit between said inner surface and said outer surface and wherein said sleeve is cylindrical.

13. The apparatus of claim 8 wherein said sleeve includes an area of increased diameter along said outer surface adjacent said leading end of said aperture and said aperture includes an area of reduced diameter adjacent said end of said aperture such that two bands of interference fit exist between said outer surface and said inner surface, one at said area of increased diameter of said outer surface and one at said area of reduced diameter of said inner surface.

14. Apparatus for supporting a cutting bit having an elongated shank and a shoulder, on a cutting element which is moveable in a cutting direction, in a bit holder having a base portion and a body portion, said base portion constructed for attachment to said cutting element, said body portion having a trailing end facing away from the cutting direction and a leading end facing in the cutting direction, said body portion further having a contact face and an aperture coaxial with the cutting bit and extending from said leading end toward said trailing end and defining an inner surface, comprising:

a sleeve member having an annular body member and a collar located at one end of said body member, said body member constructed to be received by said aperture in said body portion through said leading end of said body portion, said body member defining an outer surface, said collar having an inside surface for engagement with said contact face to prevent axial movement of said sleeve member in a direction toward said trailing end, said inside surface having a tapered portion adjacent said body member forming an undercut area in said collar, said sleeve member further having a bore therein for rotatably receiving the shank of the cutting bit such that the shoulder engages said outside surface of said collar; and retaining means on said outer surface of said sleeve for providing an area of interference fit between said inner surface and said outer surface adapted to prevent rotation and axial movement of the sleeve relative to said body portion while in use.

15. The apparatus of claim 14 wherein said means for retaining said sleeve member includes at least one band of interference fit between said inner surface and said outer surface which is shorter than said outer surface.

16. The apparatus of claim 14 wherein said means for retaining said sleeve member includes at least one band of interference fit between said inner surface and said outer surface and wherein said sleeve is cylindrical.

17. The apparatus of claim 14 wherein said means for retaining said sleeve member includes at least two discrete bands of interference fit between said inner surface and said outer surface.

18. The apparatus of claim 14 wherein said means for retaining said sleeve member includes at least two discrete bands of interference fit between said inner surface and said outer surface and wherein said sleeve is cylindrical.

19. The apparatus of claim 14 wherein said sleeve includes an area of increased diameter along said outer surface adjacent said leading end of said aperture and said aperture includes an area of reduced diameter adjacent said end of said aperture such that two bands of interference fit exist between said outer surface and said inner surface, one at said area of increased diameter of said outer surface, one at said area of increased diameter of said outer surface and one at said area of reduced diameter of said inner surface.

20. Apparatus for supporting a cutting bit having an elongated shank and a shoulder, on a cutting element which is moveable in a cutting direction, in a bit holder having a base portion and a body portion, said base portion constructed for attachment to said cutting element, said body portion having a trailing end facing away from the cutting direction and a leading end facing in the cutting direction, said body portion further having a contact face and an aperture coaxial with the cutting bit and extending from said leading end toward said trailing end and defining an inner surface, comprising:

a sleeve member having an annular body member and a collar located at one end of said body member, said body member constructed to be received by said aperture in said body portion through said leading end of said body portion, said body member defining an outer surface having an annular recess adjacent said collar, a first diameter adjacent to said annular recess and a second diameter that is less than said first diameter, said collar having an inside surface for engagement with said contact face to prevent axial movement of said sleeve member in a direction toward said trailing end, said sleeve member further having a bore therein for rotatably receiving the shank of the cutting bit such that the shoulder engages said outside surface of said collar; and retaining means on said outer surface of said sleeve member for providing an area of interference fit between said inner surface and said outer surface adapted to prevent rotation and axial movement of the sleeve member relative to said body portion while in use.

21. The apparatus of claim 20 wherein said means for retaining said sleeve member includes at least one band of interference fit between said inner surface and said outer surface which is shorter than said outer surface.

22. The apparatus of claim 20 wherein said means for retaining said sleeve member includes at least one band of interference fit between said inner surface and said outer surface and wherein said sleeve is cylindrical.

23. The apparatus of claim 20 wherein said means for retaining said sleeve member includes at least two discrete bands of interference fit between said inner surface and said outer surface.

24. The apparatus of claim 20 wherein said means for retaining said sleeve member includes at least two discrete bands of interference fit between said inner surface and said outer surface and wherein said sleeve is cylindrical.

25. The apparatus of claim 20 wherein said sleeve includes an area of increased diameter along said outer surface adjacent said leading end of said aperture and said aperture includes an area of reduced diameter adjacent said end of said aperture such that two bands of interference fit exist between said outer surface and said inner surface, one at said area of increased diameter of said outer surface and one at said area of reduced diameter of said inner surface.

* * * * *